US010607511B1

(12) United States Patent
Foegelle

(10) Patent No.: US 10,607,511 B1
(45) Date of Patent: Mar. 31, 2020

(54) POP-OUT FLAG FOR A RETAIL SHELF EDGE

(71) Applicant: Elite Creative Solutions, LLC, Broken Arrow, OK (US)

(72) Inventor: John Foegelle, Broken Arrow, OK (US)

(73) Assignee: Elite Creative Solutions, LLC, Broken Arrow, OK (US)

( * ) Notice: Subject to any disclaimer, the term of this patent is extended or adjusted under 35 U.S.C. 154(b) by 0 days.

(21) Appl. No.: 15/834,867

(22) Filed: Dec. 7, 2017

Related U.S. Application Data

(63) Continuation-in-part of application No. 15/446,883, filed on Mar. 1, 2017, now abandoned.

(60) Provisional application No. 62/301,958, filed on Mar. 1, 2016.

(51) Int. Cl.
*G09F 3/20* (2006.01)
*G09F 17/00* (2006.01)
*G09F 3/00* (2006.01)

(52) U.S. Cl.
CPC ..... *G09F 3/204* (2013.01); *G09F 3/0289* (2013.01); *G09F 3/202* (2013.01); *G09F 17/00* (2013.01); *G09F 2017/0033* (2013.01); *G09F 2017/0041* (2013.01)

(58) Field of Classification Search
CPC ..... G09F 3/204; G09F 3/0289; G09F 17/00; G09F 3/202; G09F 2017/0033; G09F 2017/0041
See application file for complete search history.

(56) References Cited

U.S. PATENT DOCUMENTS

| | | | | |
|---|---|---|---|---|
| 520,951 | A | 6/1894 | Claussen | |
| 2,632,269 | A | 3/1953 | Sanders | |
| D245,290 | S * | 8/1977 | Kingsford | D20/10 |
| 4,222,187 | A | 9/1980 | Huck | |
| 5,207,174 | A | 5/1993 | Fabbrini | |
| 5,848,698 | A | 12/1998 | Stompe | |
| D419,595 | S * | 1/2000 | Haas | D19/1 |
| 6,197,396 | B1 * | 3/2001 | Haas | G09F 3/10 283/81 |
| 6,284,338 | B1 | 9/2001 | Bauman et al. | |
| 6,688,649 | B2 | 2/2004 | Casagrande | |
| 7,055,274 | B2 | 6/2006 | Fast et al. | |
| 7,534,476 | B2 * | 5/2009 | Banks | G06K 19/041 283/81 |
| 7,779,569 | B2 | 8/2010 | Riley et al. | |
| 8,776,417 | B2 | 7/2014 | Jain et al. | |
| 2003/0066219 | A1 | 4/2003 | Palumbo | |
| 2008/0303265 | A1 | 12/2008 | Kaufman | |
| 2011/0214325 | A1 * | 9/2011 | Darress | G09F 3/08 40/661.03 |

* cited by examiner

*Primary Examiner* — Cassandra Davis
(74) *Attorney, Agent, or Firm* — Gable Gotwals

(57) ABSTRACT

A pop-out flag for use along a retail shelf edge is printed on a sheet, with information on the front and back sides of the flag being printed without having to duplex the sheet through the printer. When the flag is removed from the sheet it folds onto itself so that an adhesive trim portion of the front and back sides of the flag come into contact with one another. The pop-out design also allows the liner to remain with the face stock to add necessary stiffness to the flag.

21 Claims, 12 Drawing Sheets

POP-OUT FLAG FOR A RETAIL SHELF EDGE

CROSS-REFERENCE TO PENDING APPLICATIONS

This application claims priority to U.S. Ser. No. 15/446,883, filed Mar. 1, 2017, which in turn claimed priority to U.S. 62/301,958, filed Mar. 1, 2016.

BACKGROUND

This disclosure generally relates to retail shelf signage and, in particular, to retail shelf edge flags extending outwardly away from the shelf edge.

Edge flags are blank or pre-printed with non-variable information. This information is first printed on one side of the flag, than the other side. The finished flag is then inserted into a shelf clip. Other flags may be printed on card stock (or left blank and made out of card stock), cut out, and then folded over. However, the front and back sides bow out when inserted into the shelf clip.

SUMMARY

Embodiments of a flag for use along a retail shelf edge is made using a pop-out design arranged on a digital or laser printable sheet so that desired variable information can be printed on the front and back sides of the flag without duplexing the sheet.

The flag's pop-out design eliminates the labor and other difficulties associated with perforated designs. The pop-out design also allows the liner to remain with the face stock to add necessary stiffness to the flag, a beneficial feature for final installation purposes. Once the flag is popped-out of the sheet, the exposed adhesive allows the front and back sides of the flag to fold onto each other. A cross-cut or perforated hole in the flag's tab allows the shelf clip to pierce the folded tag.

ELEMENTS AND NUMBERING USED IN THE DRAWINGS AND DETAILED DESCRIPTION

Figure 1:
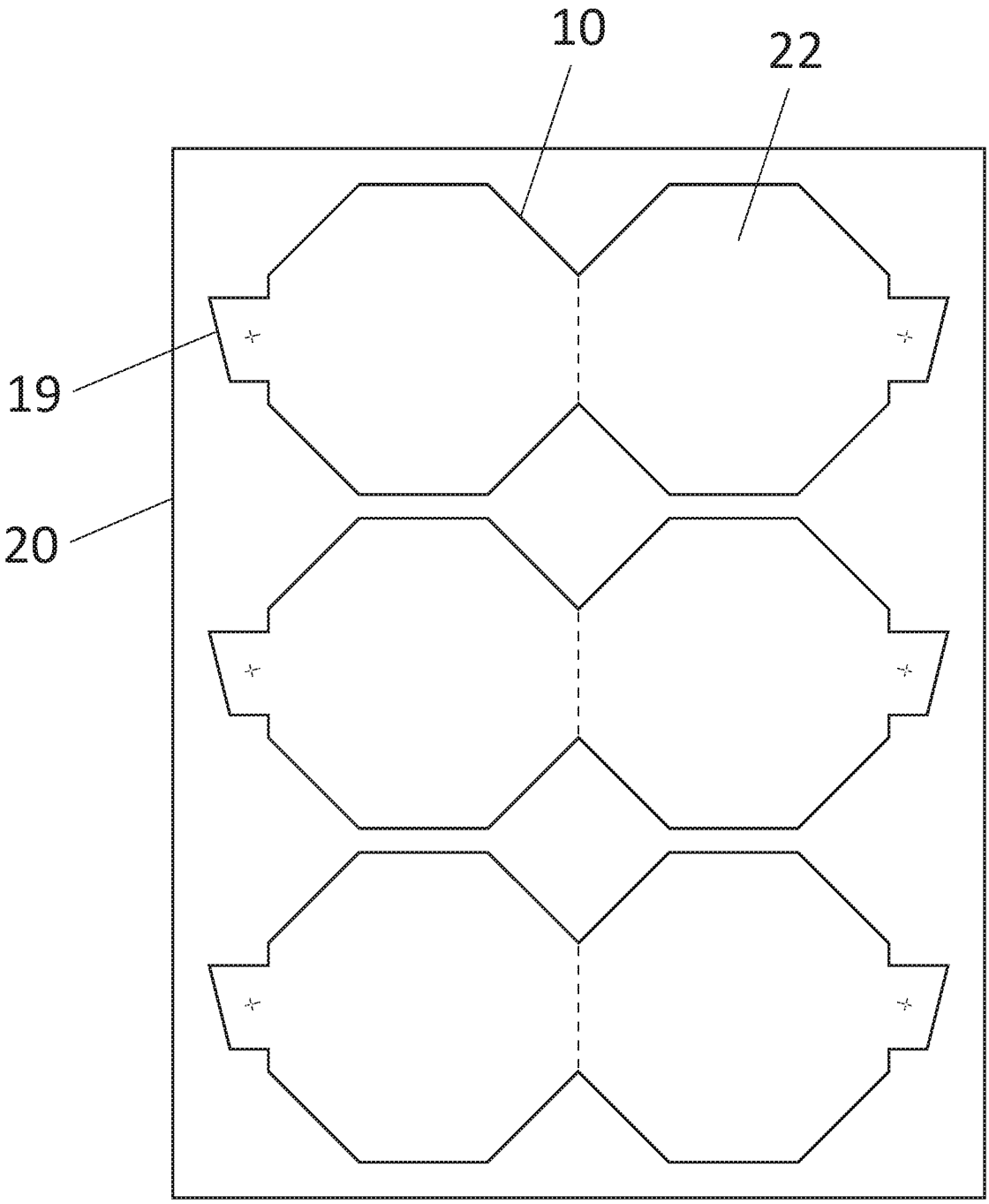
FIG. 1 is an embodiment of the laser printer printable flag arranged on a laser printable sheet.
Figure 2:
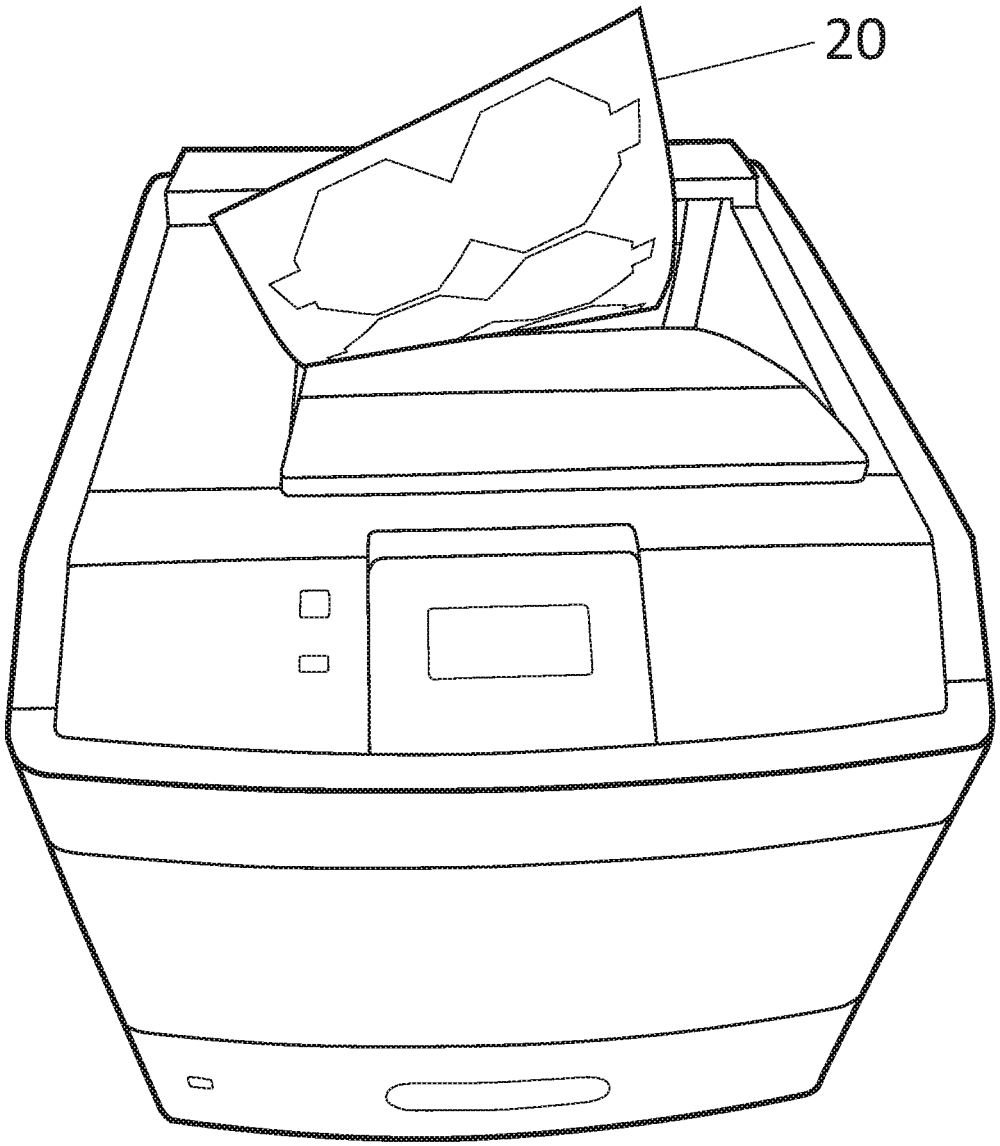
FIG. 2 is an embodiment of the sheet of FIG. 1 as it exits a laser printer. The sheet may also be digitally printed.

10 Flag
11 Front or first side
12 Front fixed or non-variable print information (first printed information)
13 Front variable print information (second different printed information)
15 Back or second side
16 Back fixed or non-variable print information (first printed information)
17 Back variable print information (second different printed information)
19 Tab for hanging
20 Laser or digital printable sheet
21 Face stock
22 Print area (main body of sides 11, 15)
23 Die cut on face
24 Void area in sheet
25 Liner backing
26 Printed Flag removed from sheet
27 Back cut in liner
29 Exposed adhesive trim or border
31 Perforated hole (cross cut through the liner)
33 Fold line—crease cut or perforated cut for folding flag
35 Adhesive layer
37 Retail shelf edge or fixture
38 Plastic shelf clip sign holder

DETAILED DESCRIPTION

This description of a printable sheet containing a flag for a retail shelf fixture makes reference to particular means, materials and embodiments, but is not intended to be limited to those particulars. Rather, the sheet extends to all functionally equivalent structures, methods and uses that fall within the scope of the claims that immediately follow the description.

Referring to the drawings, a laser printer printable flag 10 for a retail shelf fixture or edge 37 is made from a laser printable sheet 20 custom cut with a pop-out flag design. The sheet 20 is a 2-ply pressure-sensitive media which includes face stock 21, an adhesive layer 35, and a liner 25. (Adhesive is attached to back of face sheet.) The pop-out design includes a face cut 23 (to the adhesive layer 35) and a back cut 27 (through the liner 25). The distance between the face and back cuts 23, 27 provides an exposed adhesive border 29 around the flag 10 when removed from the sheet 20.

Figure 6:
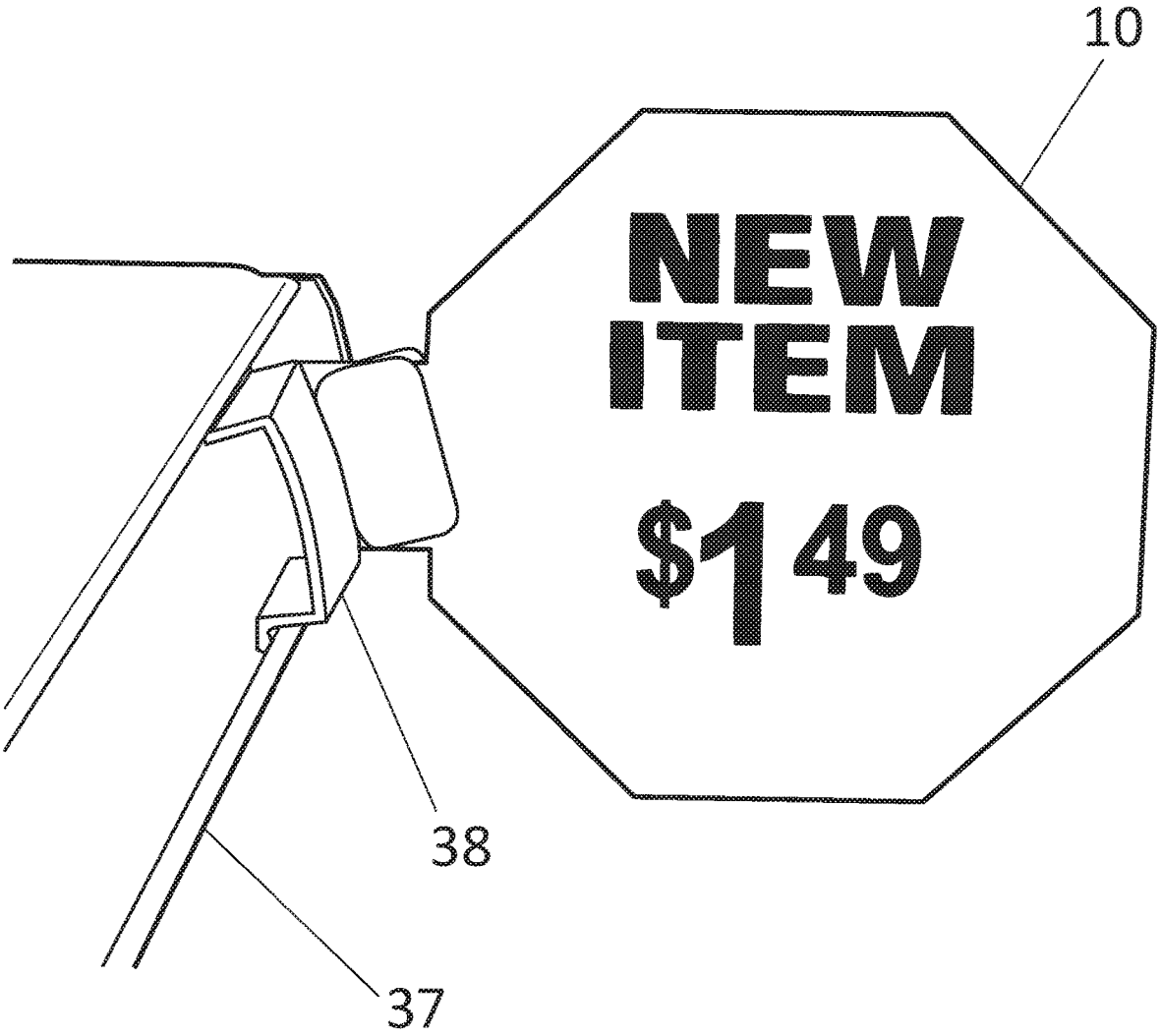
FIG. 6 is an embodiment of the assembled flag inserted into a shelf clip and installed on a shelf edge. A perforated hole in the flag's tab assists in proper positioning and allows the shelf clip to pierce the folded tag. The pop-out design allows the liner to remain with the face stock to add necessary stiffness to the flag.
Figure 7:
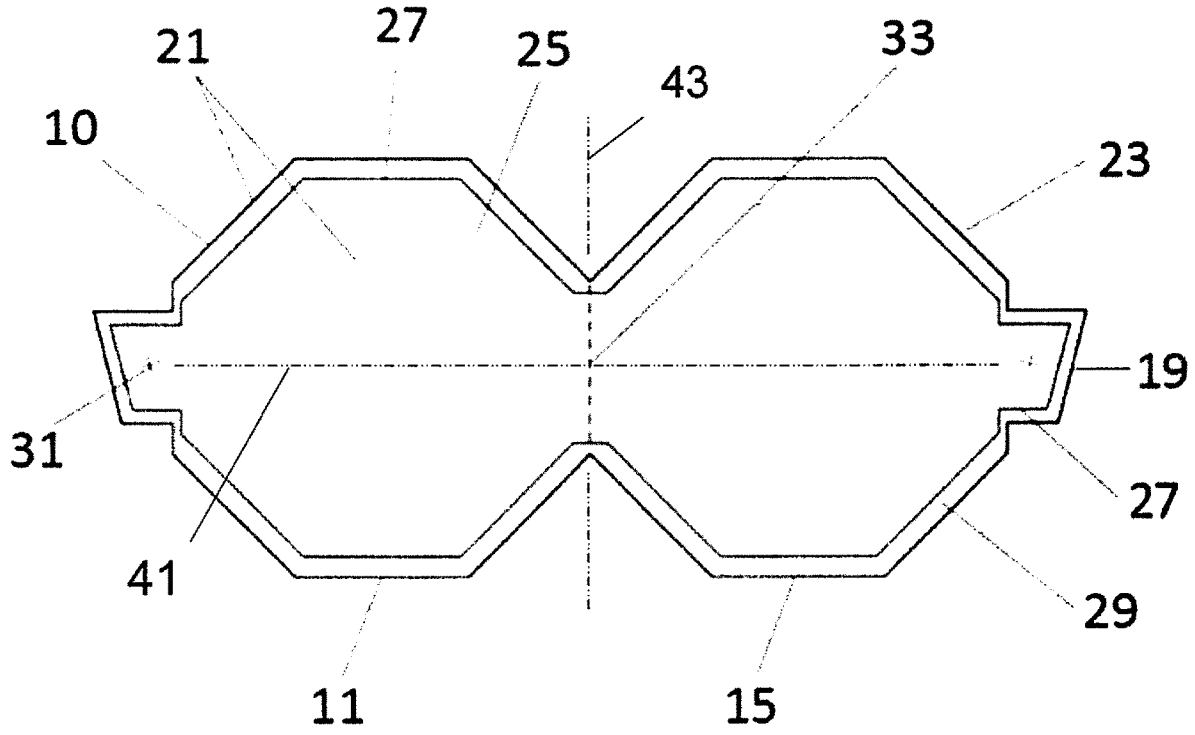
FIG. 7 is an embodiment of the flag's die cut detail when it is removed from the laser printable sheet before folding for use.
Figure 8:
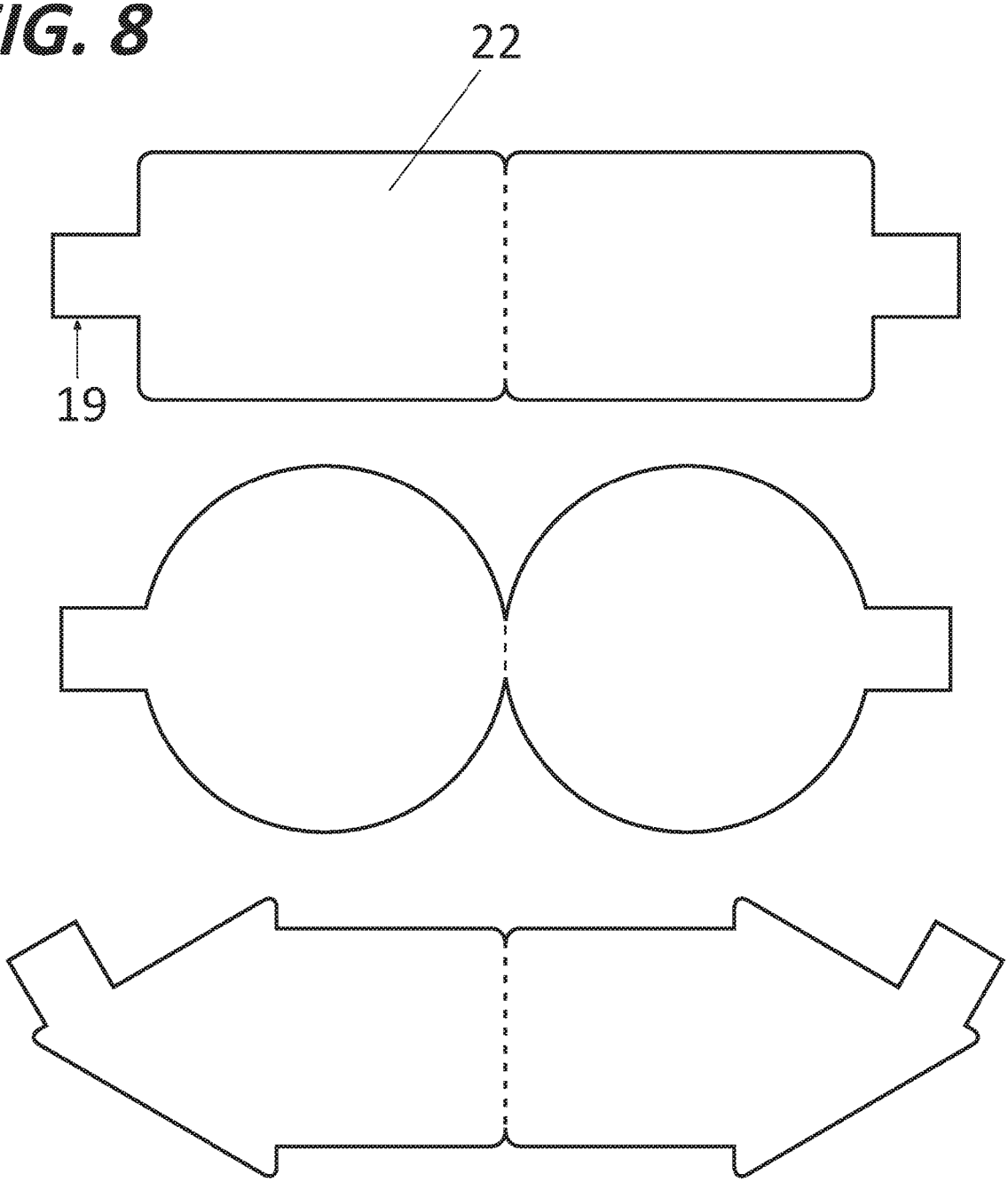
FIG. 8 is an example of other flag shapes that may be printed on the sheet.
Figure 9:
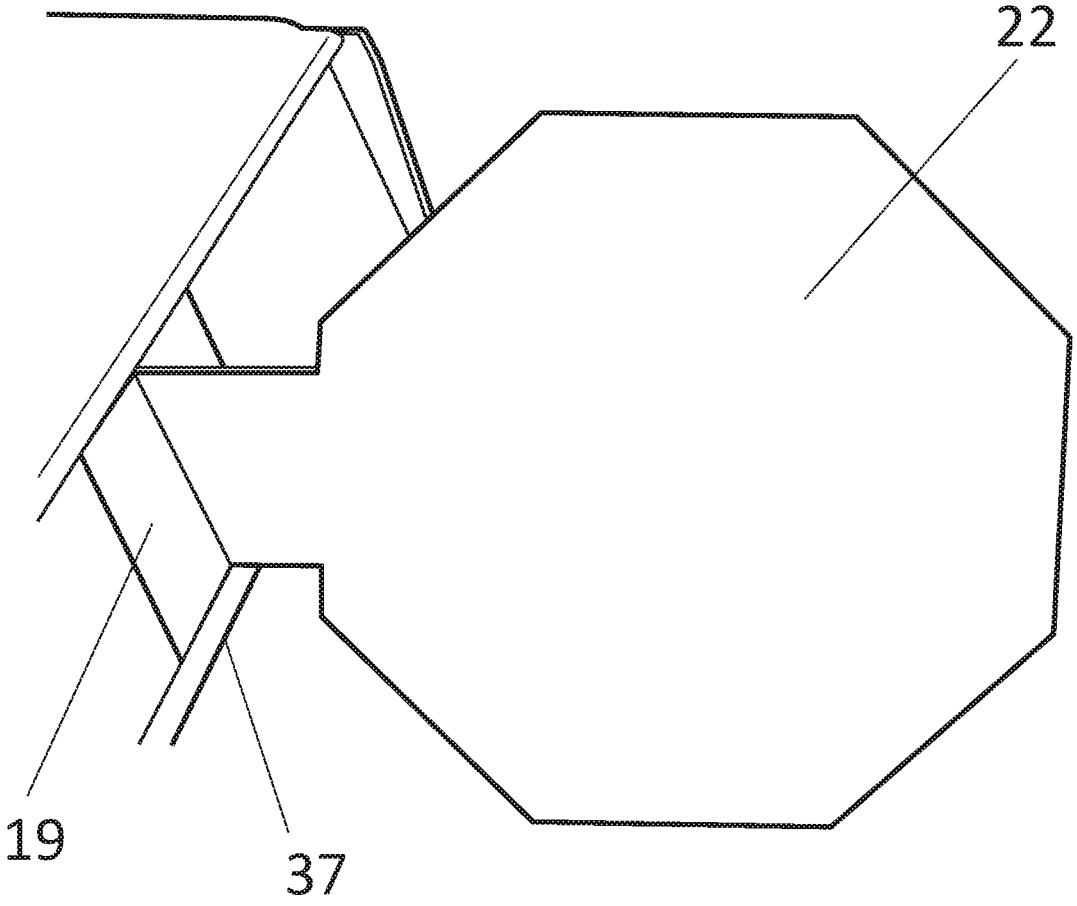
FIG. 9 is an embodiment of a flag design in which the tabs bend away from one another for insertion along a retail shelf edge or adhesion to it.
Figure 10:
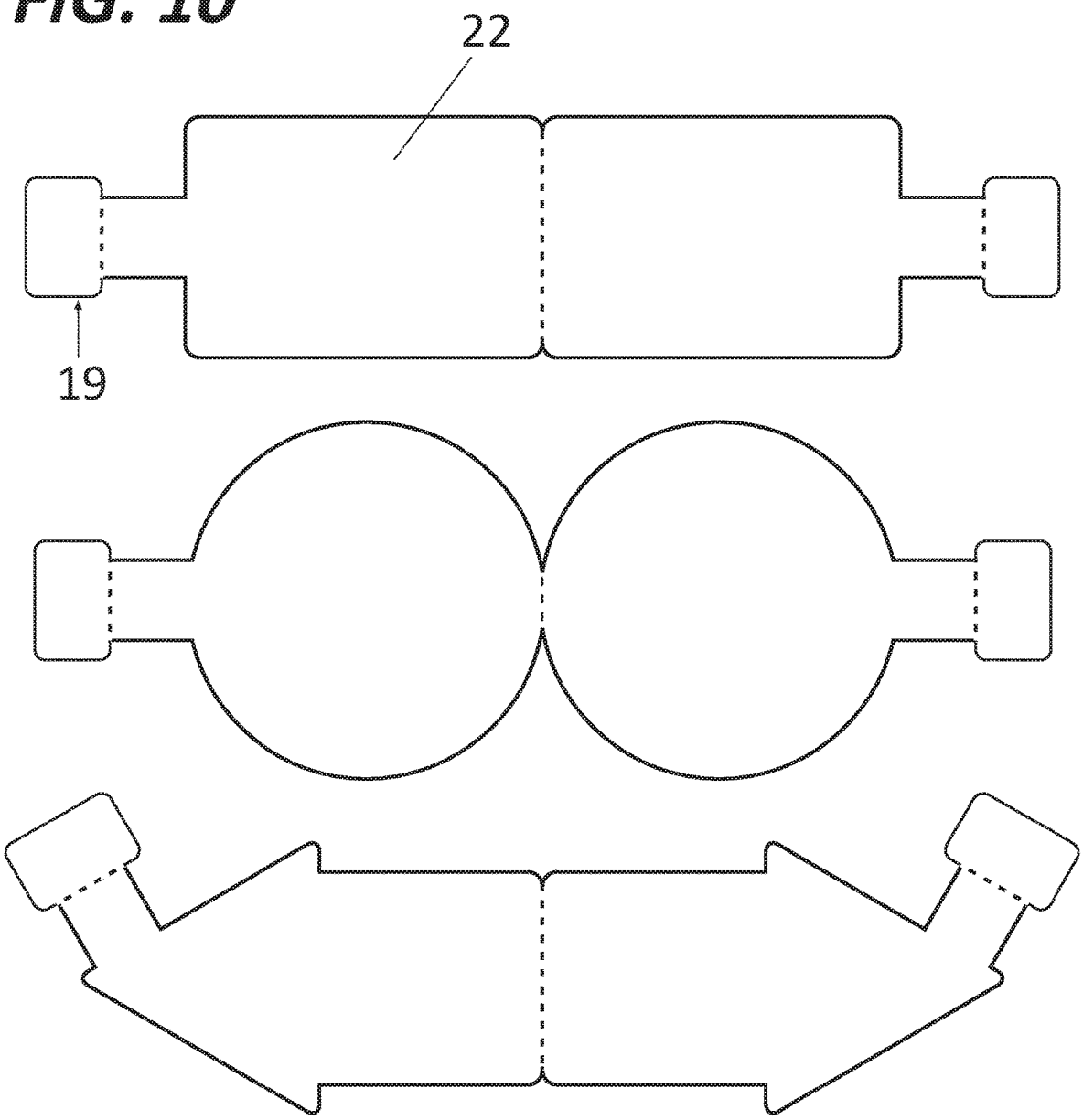
FIG. 10 is an embodiment of flag designs that include tabs that may bend away from one another.
Figure 11:
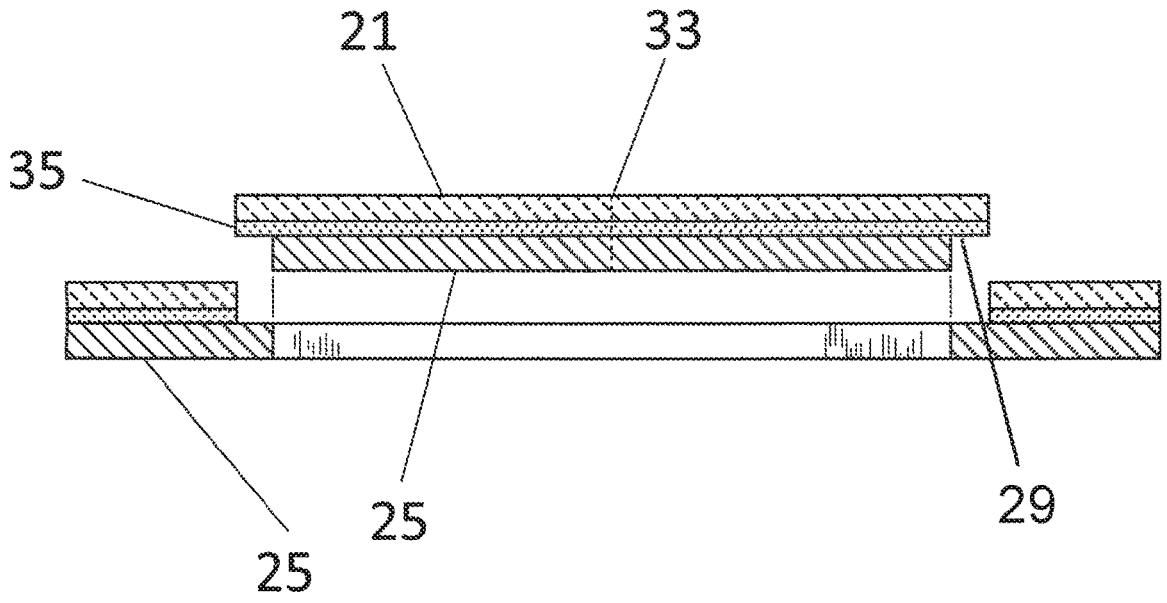
FIG. 11 is a cross-section view of a flag when removed from the printed sheet.
Figure 12:
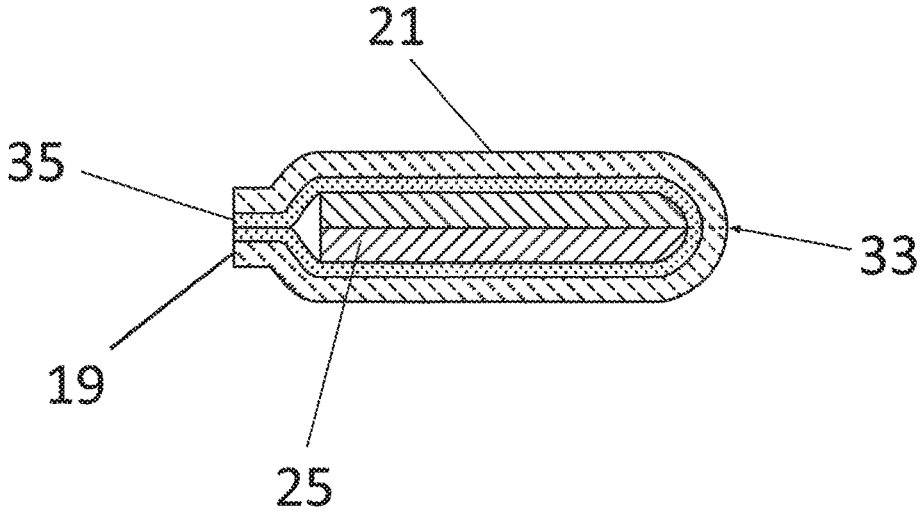
FIG. 12 is a cross-section view of a flag when folded over and the two sides adhered to one another.

The pop-out design eliminates the labor and other difficulties associated with perforated flag designs. The pop-out design also allows for reliable laser printing feed path integrity and strength, with the liner 25 remaining with the face stock 21 to add necessary stiffness to the flag 10 when installed (see e.g. FIG. 6).

Figure 3:
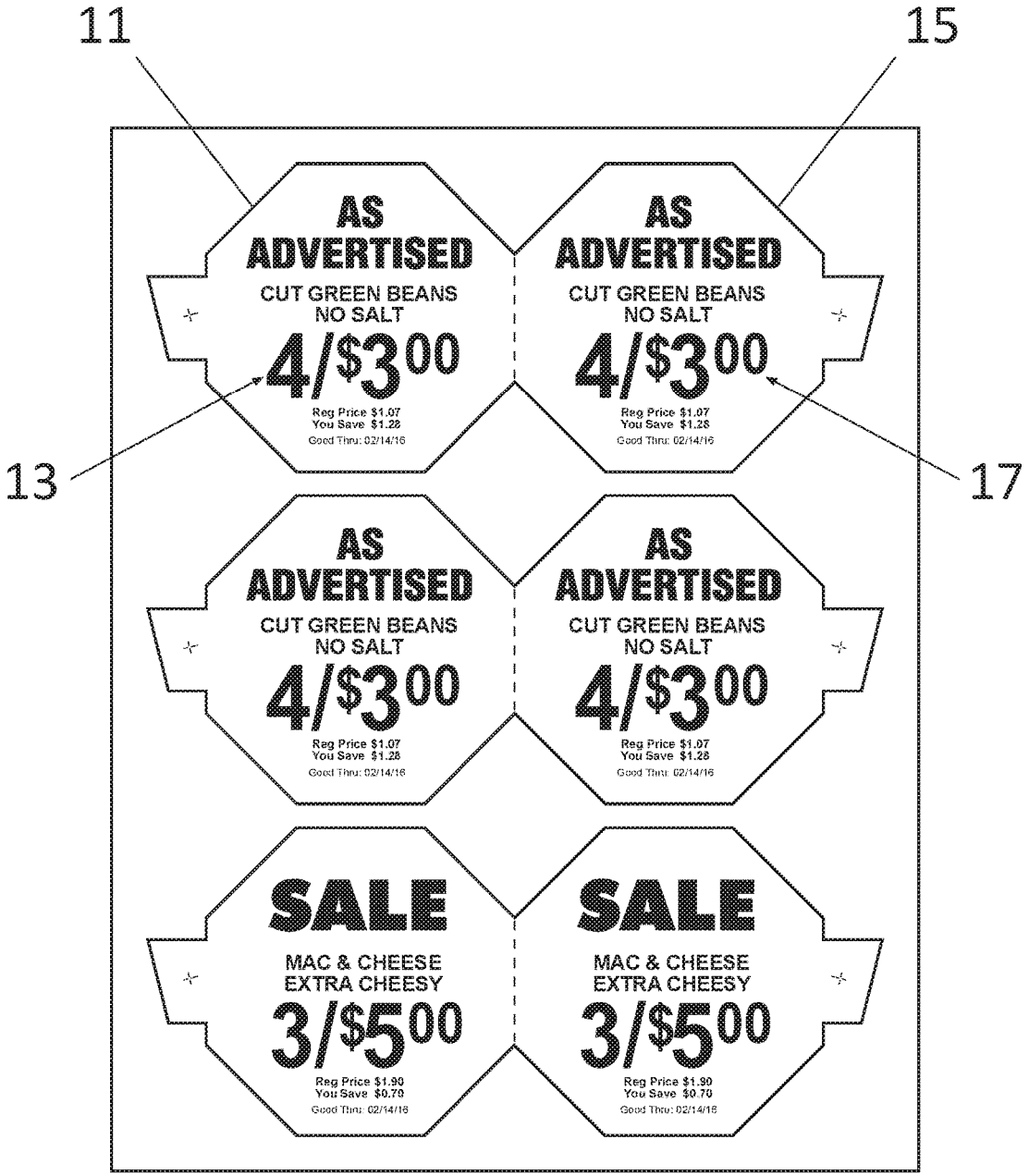
FIG. 3 is an embodiment of the digitally printed sheet.
Figure 4:
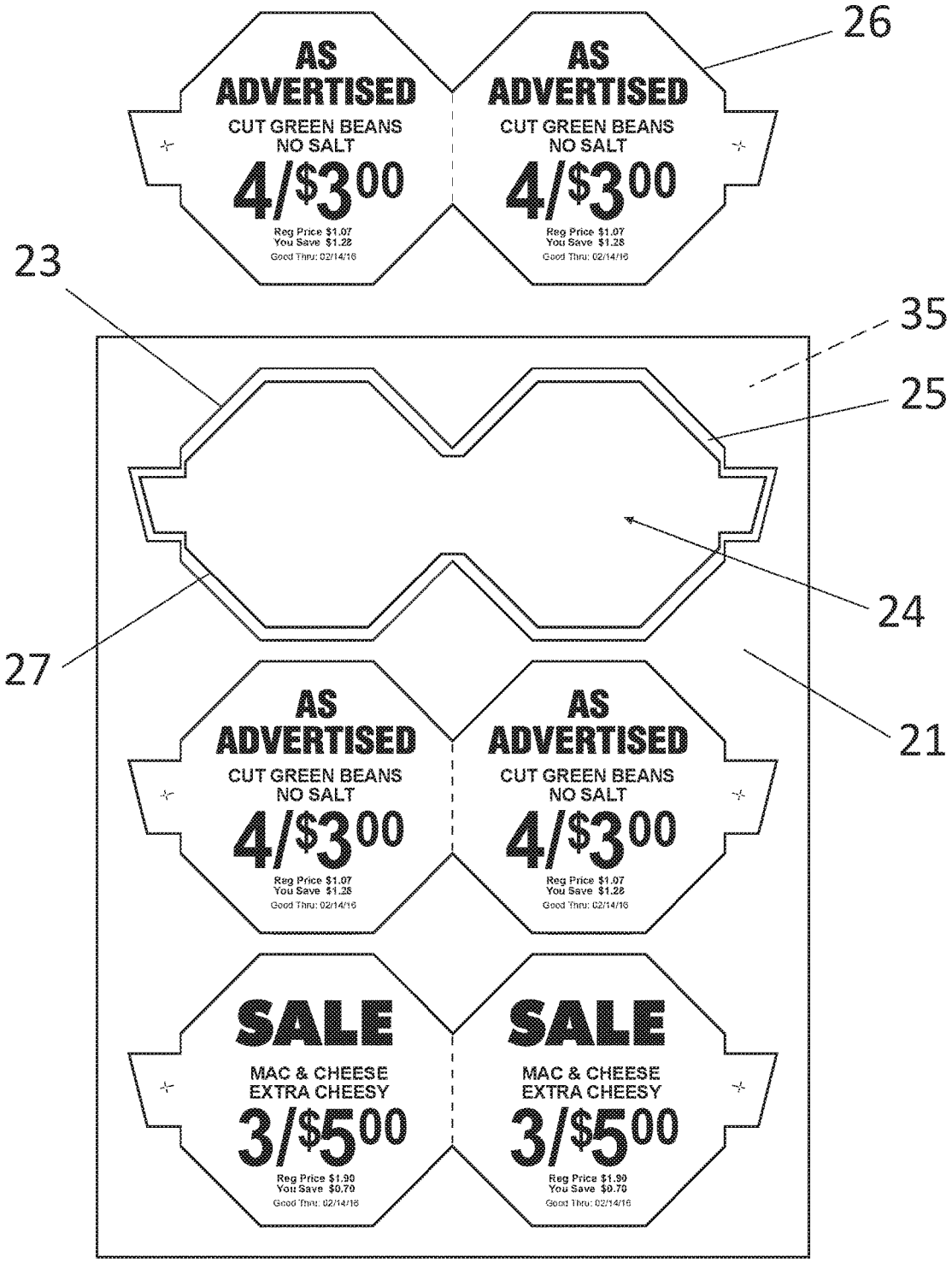
FIG. 4 is an embodiment of a printed flag when removed from the sheet. The pop-out design makes it easy to remove the flag from the sheet without the labor associated with perforated tear-down flags.
Figure 5:
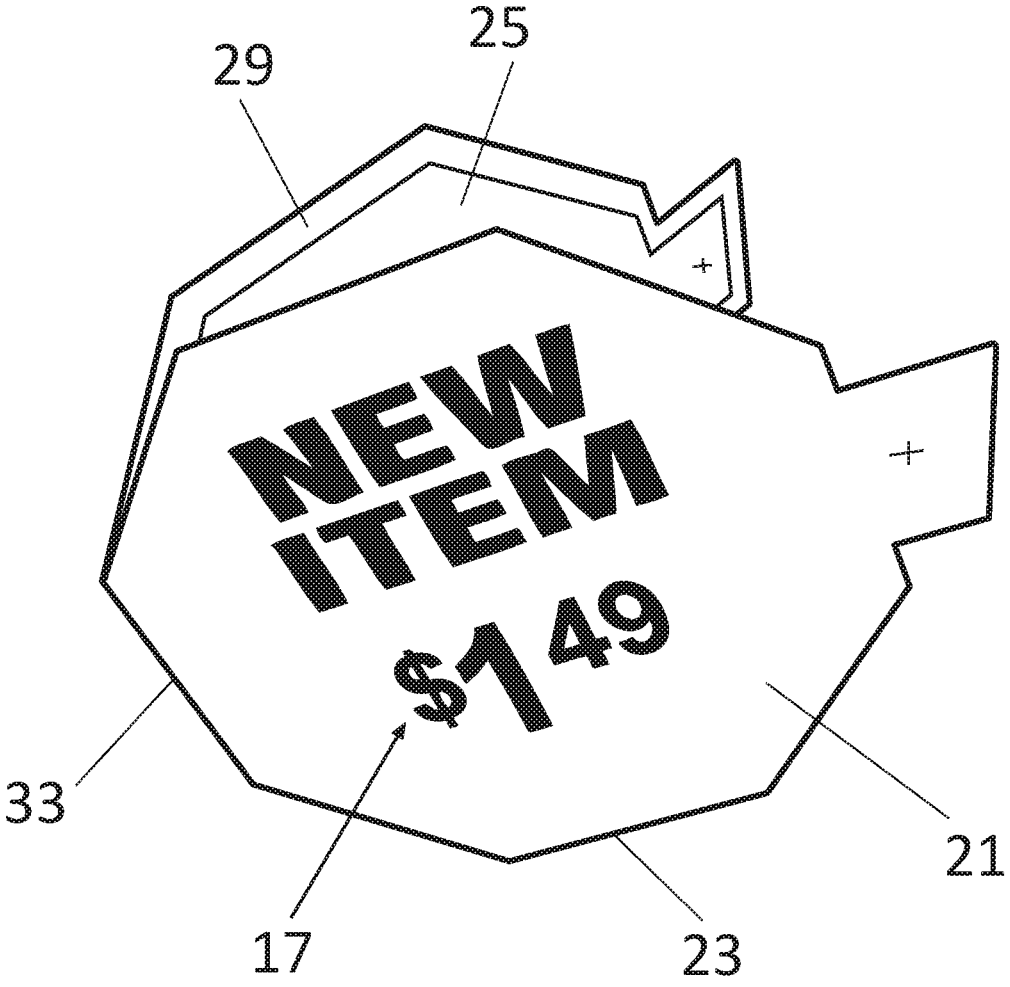
FIG. 5 is an embodiment of the removed flag with its exposed adhesive being folded on itself.
Figure 13:
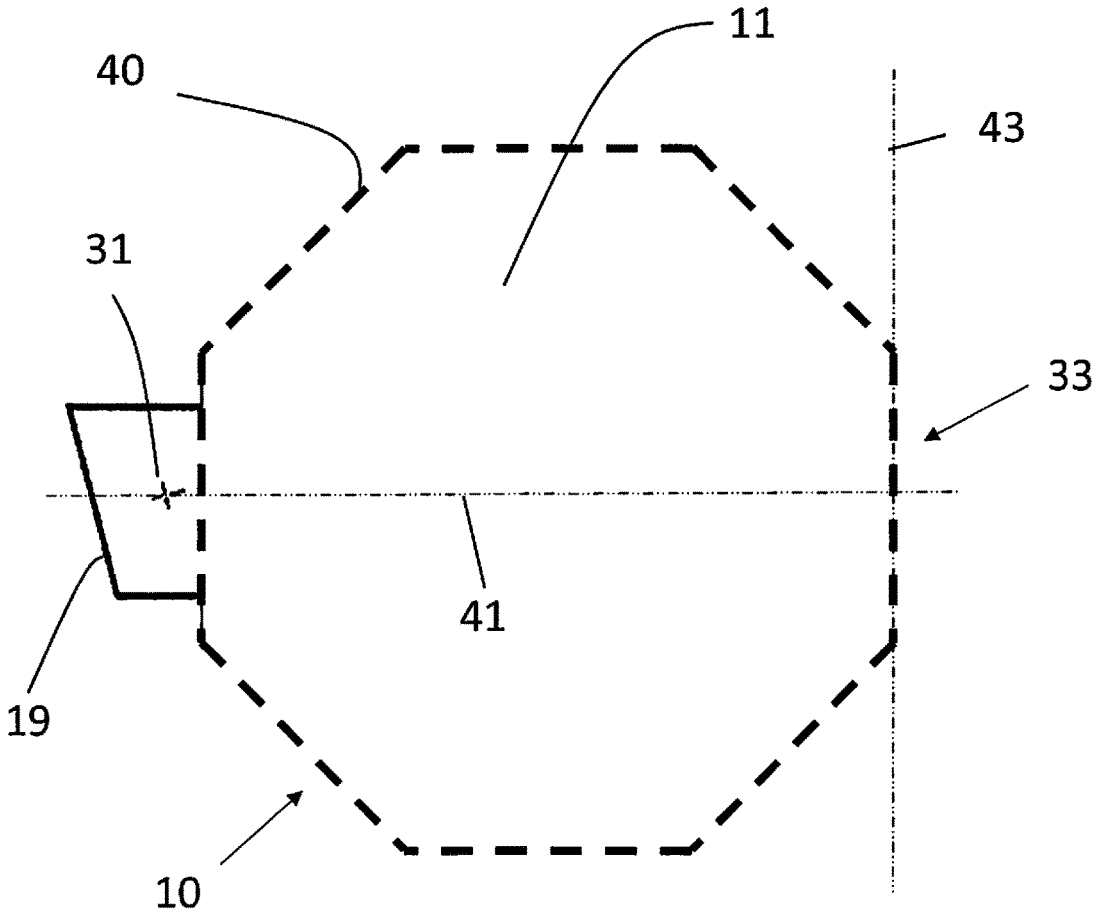
FIG. 13 is an illustration of a predetermined geometric shape (show in dashed lines) of the flag that is formed by the front and back sides of the flag when in a folded state and adhered to one another. A tab extends outward of the geometric shape for retention by a retail shelf clip.

The flag design, which can be any suitable shape 40 (e.g., square, rectangular, circular, polygonal-shaped other than square or rectangular), is arranged on the sheet 20 so that the front and back information 13, 17 on the flag 10 is printed in a side-by-side format, separated by a crease cut or perforated cut 33 through the liner 25. This eliminates the need to duplex the sheet 20 in the printer. The front and back sides 11, 15 of the flag 10 each provide an uninterrupted solid surface within the shape 40 on which to print the front and back information 13, 17. See e.g. FIGS. 3, 5, & 13. The flag 10 may also include fixed information 12, 16, which may be pre-printed by a printer using the printer's printer and a user later adding the variable information 13, 17 using the user's printer. Adjacent flags 10 may be separated by space from one another on the sheet 20.

When the flag 10 is removed from (popped-out of the sheet 20), a void area 24 is left on the sheet 20. The exposed adhesive trim 29 on the front 11 and back 15 of the flag 10 sticks to itself when the flag 10 is folded on itself. In this way, the flag 10 does not bow out when assembled like traditional folded cardstock, but instead remains flat and stuck to itself. When in this folded state the front and back sides 11, 15 define a predetermined geometric shape 40 of the flag 10 and the tab 19 extends outward of the geometric shape 14. See e.g. FIGS. 3, 5, 12, & 13.

A tab 19 extends from a print area 22 of each side 11, 15 of the flag 10. The tab 19 is smaller in width and height than that of the print area 22. A perforated hole or t-shaped or cross-shaped cut 31 may be included in the tab 19 to allow the shelf clip 38 to pierce the folded hanging tab 19. In other embodiments, the tab 19 may be bent for retention along a retail shelf edge 37. In embodiments the tab 19 is located opposite the fold line 33 and along a horizontal centerline 41 of the flag 10, the fold line 33 being located along the vertical centerline 43 when unfolded, where horizontal and vertical are determined by the intended correct orientation of the flag 10 when connected to a retail shelf clip 38. See e.g. FIGS. 6 & 13. The t-shaped or cross-shaped cut 31 may be located along the horizontal centerline 41 as it passes through the tab 19.

The following claims include the full range of equivalents to which recited element is entitled.

What is claimed:

1. A printable sheet comprising:

a plurality of retail shelf edge perpendicular flags, each flag of the plurality including:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet along the face cut;

the first and second sides each containing a print area and a tab extending from the print area, the tab being located on a side opposite the fold line and being smaller in height and width than the print area and containing a cross-shaped perforation on the face stock side through the liner;

wherein in a folded state the first and second sides adhere to one another along the exposed adhesive border and define a predetermined geometric shape of the flag, the tab extends from the predetermined geometric shape, each of the sides being an uninterrupted solid surface within the predetermined geometric shape; and wherein at least two adjacent flags of the plurality are separated by space on the printed sheet.

2. A printable sheet according to claim 1, the print area including a first and a second different set of information, the first set of information being printed by a first printer and the second different set of information being printed by a second different printer.

3. A printable sheet according to claim 1, wherein an exposed adhesive border of the first side comes into contact with an opposing exposed adhesive border of the second side when the flag is folded onto itself along the fold line.

4. A printable sheet according to claim 1, the fold line being selected from the group consisting of a crease cut and a perforated cut.

5. A printable sheet according to claim 1, wherein the print area is polygonal shaped.

6. A printable sheet according to claim 1, wherein the print area is polygonal shaped other than square- or rectangular shaped.

7. A printable sheet according to claim 1, wherein the print area is circular shaped.

8. A printable sheet according to claim 1, the cross-shaped perforation moving between a perforated state and a punctured state including a hole when the tab is connected to a retail shelf edge.

9. A printable sheet comprising:

a plurality of retail shelf perpendicular flags, each flag of the plurality including:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet;

the first and second sides each containing a print area and a tab extending from the print area, the tab being located on a side opposite the fold line and being smaller in height and width than the print area and containing a cross-shaped perforation on the face stock side through the liner, the print area including a first set of information printed by a first printer;

wherein in a folded state the first and second sides adhere to one another along the exposed adhesive border and define a predetermined geometric shape of the flag, the tab extends from the predetermined geometric shape, each of the sides being an uninterrupted solid surface within the predetermined geometric shape; and wherein at least two adjacent flags of the plurality are separated by space on the printed sheet.

10. A printable sheet according to claim 9, the print area including a second different set of information, the second different set of information being printed by a second different printer.

11. A printable sheet according to claim 9, the fold line being selected from the group consisting of a crease cut and a perforated cut.

12. A printable sheet according to claim 9, wherein the print area is polygonal shaped.

13. A printable sheet according to claim 9, wherein the print area is polygonal shaped other than square- or rectangular shaped.

14. A printable sheet according to claim 9, wherein the print area is circular shaped.

15. A printable sheet according to claim 9, the cross-shaped perforation moving between a perforated state and a punctured state including a hole when the tab is connected to a retail shelf edge.

16. A method of making a retail shelf edge perpendicular flag, the method comprising:

providing a printable sheet that contains a plurality of retail shelf perpendicular flags removeable from the printable sheet wherein at least two adjacent flags of the plurality are separated by space on the printed sheet, wherein each flag of the plurality includes:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet;

the first and second sides each containing a print area and a tab extending from the print area, the tab being located on a side opposite the fold line and being smaller in height and width than the print area and containing a cross-shaped perforation on the face stock side through the liner, the print area including a first set of information printed by a first printer;

wherein in a folded state the first and second sides adhered to one another along the exposed adhesive border and define a predetermined geometric shape of the flag, the tab extends from the predetermined geometric shape, each of the sides being an uninterrupted solid surface within the predetermined geometric shape.

17. A method according to claim 16, further comprising printing on the print area a second set of information different than the first set of information.

18. A method according to claim 17, wherein the second set of information is printed by a second different printer.

19. A method according to claim 16, further comprising: removing one of the flags from the printable sheet to expose an adhesive border of the first side and an adhesive border of the second side; and folding the flag onto itself so the exposed adhesive borders come into contact with one another.

20. A method according to claim 19 further comprising connecting the tab to a retail shelf edge.

21. A method according to claim 20, the cross-shaped perforation moving between a perforated state and a punctured state including a hole when the tabs are connected to the retail shelf edge.

* * * * *